United States Patent [19]

Emmerich et al.

[11] 4,190,125

[45] Feb. 26, 1980

[54] DRILL BIT AND STEEL COMBINATION FOR IMPROVED FLUID FLOW

[75] Inventors: Kenneth C. Emmerich; Ralston L. Hamlin, both of Lexington, Ky.

[73] Assignee: Fansteel Inc., North Chicago, Ill.

[21] Appl. No.: 849,995

[22] Filed: Nov. 9, 1977

[51] Int. Cl.[2] ..... E21C 13/10; E21C 15/00

[52] U.S. Cl. ..... 175/410; 175/320; 175/411; 175/418; 408/226

[58] Field of Search ..... 175/320, 410, 411, 415, 175/417, 418, 419, 414, 215; 279/20; 408/59, 226

[56] References Cited

U.S. PATENT DOCUMENTS

| | | | |
|---|---|---|---|
| 1,169,369 | 1/1916 | Wakfer | 175/419 X |
| 3,163,246 | 12/1964 | Vagins et al. | 175/415 X |
| 3,187,825 | 6/1965 | Bower, Jr. | 175/320 X |
| 3,434,554 | 3/1969 | Bower, Jr. | 175/410 |
| 3,807,515 | 4/1974 | Evans | 175/410 |
| 4,043,409 | 8/1977 | Walter | 175/414 X |
| 4,099,585 | 7/1978 | Emmerich | 175/320 |

FOREIGN PATENT DOCUMENTS

| | | | |
|---|---|---|---|
| 668991 | 3/1952 | United Kingdom | 175/410 |
| 880803 | 10/1961 | United Kingdom | 175/410 |

*Primary Examiner*—Ernest R. Purser
*Assistant Examiner*—Nick A. Nichols, Jr.
*Attorney, Agent, or Firm*—Barnes, Kisselle, Raisch & Choate

[57] ABSTRACT

An improved roof drill bit for use in mining operations in which a carbide insert is diametrically located in a cylindrical body and held on axial prongs in diametrically opposed quadrants of the body by a brazed connection; diverging axial holes for coolant are positioned in said prongs to open at the trailing side of the cutting edges of the carbide insert to flood the edges with coolant liquid and flush cuttings into the other quadrants. The coolant passages also pass near the brazed face of the insert to cool the body in this area and minimize softening of the braze. The bit shank and driving steel have cooperating axial grooves forming a passage for the coolant liquid to the bit body. The driving steel and bit body also have aligned chordal sides providing a passage for flushing drilling chips and fines toward the mouth of the hole.

4 Claims, 9 Drawing Figures

DRILL BIT AND STEEL COMBINATION FOR IMPROVED FLUID FLOW

This invention relates to an improved mining drill bit and more particularly to a bit which is water cooled with passages internally of the bit.

Reference is made to copending applications, having an assignee common to that of the present application and disclosing related subject matter, as follows:

Emmerich—Ser. No. 749,457—Filed Dec. 10, 1976, now abandoned

Emmerich—Ser. No. 760,712—Filed Jan. 19, 1977, now U.S. Pat. No. 4,099,585

Wise et al—Ser. No. 808,779—Filed June 22, 1977

Mining drill bits used for roof drilling and other ore or rock drilling applications are subject to rotation, and sometimes percussion as well as rotation, in materials which are extremely hard and abrasive. The cuttings must be flushed away from the drill bits and there is considerable heat developed in the cutting operations.

It has become common to utilize a hard cutting insert formed of a material such as tungsten carbide and extending diametrically across the end of the steel drill bit. This insert is brazed in place. However, the extreme heat developed in the drilling operation, together with the shock of rotation and percussion, has caused rapid wear of the bit, and softening of the braze and loosening of the insert which results in downtime while bits were being replaced. Even air or water cooling of the bits in the standard fashion has not solved this problem.

When deep holes are being drilled, it will be appreciated that breakage or dulling which requires changing of the bits will cause loss of drilling time. Also, any increase in drilling speed and drill bit life will greatly increase the efficiency of the operation. The cost of labor and the cost of bits is such that any increase in bit life has great commercial significance.

It is an object of the present invention to provide a drill bit design which greatly increases cutting speed and reduces drill bit wear and deterioration.

It is a further object to provide a bit design which enhances the coolant flow and the cuttings removal while improving the cooling function of the coolant not only on the cutting edges but in the body of the bit to prevent softening of the braze joint of the carbide insert in the drill body.

A further object is the provision of a drill body which has increased flow channels for cuttings, thus reducing erosion of the bit and reducing the possibilities of "plugging," that is, pile up of dust and cuttings at the bit end.

Other objects and features of the invention will be apparent in the following description and claims in which the invention is set forth together with details which will enable a person skilled in the art to practice the invention, all in connection with the best mode presently contemplated for the invention.

Figure 1:
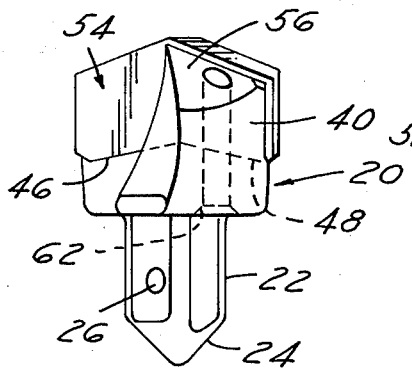

DRAWINGS accompany the disclosure and the various views thereof may be briefly described as:

FIG. 1, a side elevation of a drill bit.

Figure 2:
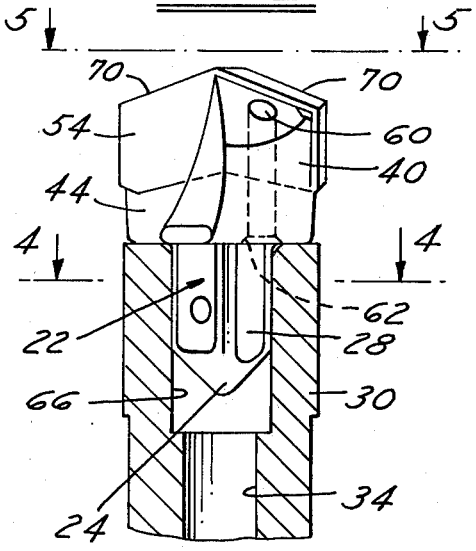

FIG. 2, a view of the drill bit mounted in a driving steel.

Figure 3:
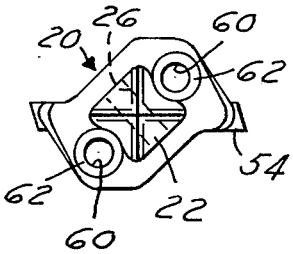

FIG. 3, a view of the shank end of the drill bit.

Figure 4:
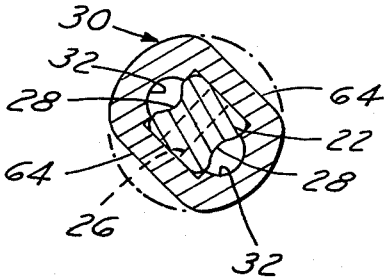

FIG. 4, a sectional view on line 4—4 of FIG. 2.

Figure 5:
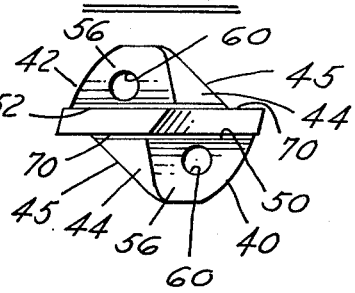

FIG. 5, an end view of the assembled bit taken on line 5—5 of FIG. 2.

Figure 6:
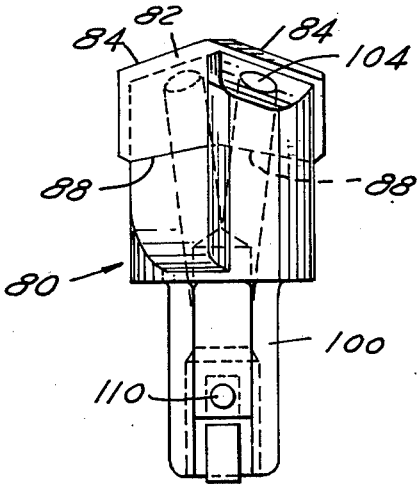

FIG. 6, a side elevation of a modified bit construction.

Figure 7:
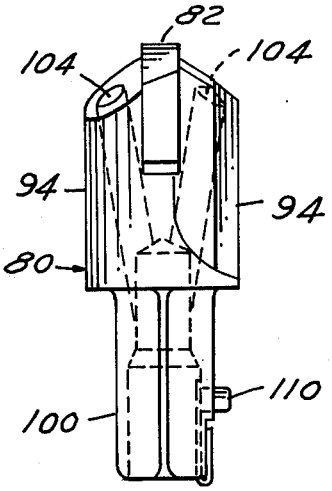

FIG. 7, a view of the bit taken at 90° to the view of FIG. 6.

Figure 8:
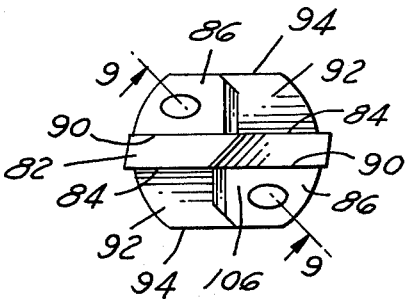

FIG. 8, an end view of the bit.

Figure 9:
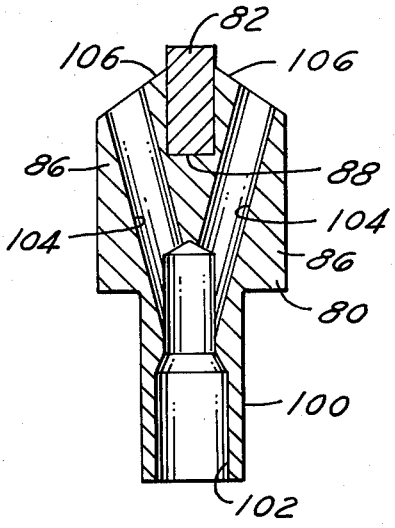

FIG. 9, a sectional view on line 9—9 of FIG. 8.

The present invention is directed to a water cooled bit having a hard metal insert positioned diametrically of the bit and brazed in place. The mining drill bits are generally mounted on and driven by a steel rod known as a "driver" which is connected to a rotating power source. When deep holes are drilled, intermediate drill steels will be used to extend the drive, these rods having one end to connect to the driver and another end to form a driving connection to the drill bit. Usually these drivers and drill steels are hollow and will carry a coolant fluid to the drill bit. The coolant has variously been discharged at the end of the drill steel adjacent the drill bit and even through holes in the body of the drill bit at the base. The coolant is intended to reduce the temperature of the drill bit body and flush drill cuttings down the hole around the outside of the drill driving steels.

The present invention contemplates running the coolant passages in the drill bit body right up to the tip of the drill in close proximity to the cutting insert. The outlet of each passage is directly adjacent the trailing edge of one side of the insert. The passage itself is in the body directly behind the main brazed surfaces which hold the insert in place. Thus, there is an improved delivery of the coolant to flush the cutting edge and start the reverse flow of cuttings, but there is also a body cooling function which by conduction maintains the brazed areas in a safe temperature range.

Two specific embodiments of the invention are illustrated and described herein.

In FIGS. 1 to 5, the first embodiment is shown. In FIG. 1, the drill body 20 is illustrated having an acircular driving shank 22 which, as shown in FIGS. 3 and 4, in this instance has a square cross-section with a tapered end 24. A transverse hole 26 extends through the shank to receive a retention pin. Opposite sides of this shank are grooved at 28 to provide coolant flow passages in combination with the interior of a drill steel 30 as shown best in FIG. 4.

The interior of the drill steel has opposed grooves 32 which cooperate with the groove 28 to provide a pair of coolant passages connected to an interior bore 34 of the drill steel. The body of the drill bit 20 is cut away in diametrically opposed quadrants to provide two upwardly extending prongs 40 and 42. The material in the other quadrants of the bit curves downwardly at the base of the prongs to provide a flush surface 44. Each side of the body is narrowed chordally at 45 at the base of the surfaces 44 to allow cuttings to flush away along the outside of the drill steels. The body 20 is provided with a diametrical slot between the prongs 40 and 42 with angled base ledge surfaces 46 and 48, and this leaves flat backing surfaces 50 and 52 extending axially from these base surfaces. A hard metal cutting insert 54 is fitted into the slot between the prongs and brazed into place on the bottom ledge surfaces 46 and 48 and the chordal wall surfaces 50 and 52. Extending through the prongs from the bottom of the body portion 20 to an angled relief surface 56 at the distal end of the prongs are coolant passages 60 which at the bottom are in line with the passage formed by the openings 28–32 in the shank and drill steel. The bottom of each hole 60 is chamfered at 62.

Since each hole 60 is smaller than the total area of the passages 28–32, there is a blending of these passages into the chamfer in such a way as to create a venturi action through the holes 60. It will be noted that each passage 60 is relatively close to the walls 50 and 52 of the prongs and also passes relatively close to the supporting ledges 46 and 48. The drill steel 30 is provided with flat portions 64 to facilitate the outward flow of cuttings from the surfaces 44. The steel, of course, has a square hole 66 to receive the square shank 28 in a driving relationship.

In the operation of the device, it will be seen that the drill bit is assembled with a suitable braze between the contacting surfaces of the hard metal insert and the prongs of the drill bit body. The hard metal insert, of course, can be one of various grades of tungsten carbide or other hard cutting materials. The square shank of the drill bit is assembled into the square opening of the drill steel 30 in a driving relationship and the shoulders of the body 20 seat against the end of the drill steel. The cutting edge of the carbide inserts is shown at 70 and the carbide angles down and back from the cutting edge to provide a work clearance.

Thus, in the drilling operation, as coolant is forced under pressure through the passage 34, it will diverge into the passages 28–32 on each side of the shank 22 and enter the chamfer 62 and the passages 60 discharging at the distal end of the prongs directly behind the cutting edge 70. On the cutting edge side of the insert is the open quadrant so that coolant through the holes 60 will flush chips away from the cutting edge and down into the open quadrant of the drill bit where they will flow past the chordal surface 45 and the flats 64 and down around the drill steels to the opening of the hole being drilled. At the same time, the metallic steel body 20 of the drill bit, which can be cast or forged, will be cooled by the coolant prior to the time that it has reached the cutting edge. The proximity of the holes 60 to the surfaces 46–48 and 50–52 will make it possible for the coolant, in combination with the conductive characteristics of the metal body, to maintain a safe temperature in the body so that the bronze on these surfaces will be maintained in a solid condition.

Thus, the normal heat that is developed in the drilling operation will not have a chance to build up in the drill bit body to a point where it would tend to soften the brazed areas. It will thus be seen that extending the passages 60 through the supporting prongs of the drill bit not only places the outlet of these passages at an ideal point for the flushing of the drilling edges 70, but it will also, by conduction, maintain safe temperatures in the drill body with respect to the brazed surfaces.

In FIGS. 6 to 9, a modification is illustrated in which the drill body 80 has a diametrically positioned cutting insert 82 with cutting edges 84 positioned on the diametrically opposed prongs 86 of the body. The cutting insert 82 is brazed into place on the supporting ledges 88 and against the supporting walls 90. The empty quadrants terminate at the bottom in a curved surface 92 which opens to a chordal flat 94 on the drill bit body. The acircular shank 100 of the drill bit body is in this instance hexagonal in cross-section and provided with a central coolant bore 102 which diverges into coolant passages 104 terminating at the angled surfaces 106 at the distal end of the supporting prongs 86. A spring retainer 110, shown in FIG. 7, cooperates with an opening in a drill steel to retain the device during operation.

The operation of this embodiment of the drill bit is functionally the same as that shown in FIGS. 1 to 5. Coolant comes from the hollow drill steel to the passage 102 where it diverges into passages 104 and is directed to the cutting edges 84 of the cutting insert 82 where it will flush cuttings down into the empty quadrants 92 and past the flats 94. At the same time, the coolant passes close to the surfaces 88 and 90 where is located the brazed joint between the body and the insert 82. The conduction from the metallic body will transmit heat to the coolant when it is in its coolest state before it reaches the end of the drill body and thus insure stability of the braze joint.

Actual tests of the drill bits disclosed above has shown a marked improvement in the penetration rate and bit life compared to standard drill bits. An increase of 36 percent in drilling rate was achieved in a series of tests connected in roof drilling in a mine. The bit life also was greatly improved in comparison with the standard bits formed of the same material.

What is claimed as new is as follows:

1. In combination, a mining drill bit and driving steel for rotary and rotary percussion drilling of hard materials such as rock, coal, concrete and the like which comprises:

(a) a central metallic, heat conductive body generally round in cross-section and having a central axis, (b) an acircular driving shank of substantially smaller diameter than said body axially disposed on one end of said body having a cooling passage formed therein extending to said body, (c) a hard metal cutting insert supported diametrically at the other end of said body comprising a flat elongate member having leading cutting edges on the top of said member on opposite sides of the axis of said body and on opposite sides of the member with a clearance angle surface angled downward from the leading edge toward a trailing edge on each side of the member, (d) support prongs extending axially of said body in diametrically opposed quadrants having ledge surfaces in contact with the bottom of said insert and back-up, axially extending chordal surfaces in contact with a trailing side of said insert, said insert being brazed to said prongs at said ledge and back-up surfaces, (e) passages formed in said prongs in communication with a shank passage extending axially to the distal end of said prongs and passing behind and adjacent to said back-up chordal surfaces and terminating adjacent the cutting edges of said insert and to conduct heat away from said ledge and back-up surfaces to prevent destructive heating of said brazed surfaces, (f) said body having opposed, parallel, chordal sides at the base of the body below the leading cutting edges of said cutting insert, and (g) a driving steel having a central acircular recess to receive said shank in a driving relation and having opposed, parallel, external chordal sides aligned with the chordal sides on said bit body to provide a passage within a hole being drilled for the flushing away of drilling chips and fines toward the mouth of the hole.

2. A mining drill bit for rotary and rotary percussion drilling of hard materials such as rock, coal, concrete and the like which comprises:

(a) a central metallic, heat conductive body generally round in cross-section and having a central axis, (b) a solid acircular driving shank of substantially smaller diameter than said body axially disposed on one end of said body having external coolant grooves on opposite faces of said shank, (c) a hard metal cutting insert supported diametrically at the other end of said body comprising a flat elongate member having leading cutting edges of the top of said member on opposite sides of the axis of said body and on opposite sides of the member with a clearance angle surface angled downward from the leading edge toward a trailing edge on each side of the member, (d) support prongs extending axially of said body in diametrically opposed quadrants having ledge surfaces in contact with the bottom of said insert and back-up, axially extending chordal surfaces in contact with a trailing side of said insert, said insert being brazed to said prongs at said ledge and back-up surfaces, and (e) passages formed in said support prongs originating respectively at the top of said external grooves in said driving shank and extending axially to the distal end of said prongs and passing behind and adjacent to said back-up chordal surfaces and terminating adjacent the trailing edges of said cutting insert to conduct heat away from said ledge and back-up surfaces to prevent destructive heating of said brazed surfaces.

3. A combination including the mining drill bit as defined in claim 2 and a driving steel having a recess to receive said solid acircular driving shank formed with complemental walls to provide a driving relationship with said shank, and having passages formed on the internal walls of said recess to lie adjacent the external axial grooves of said shank to provide coolant supply passages leading to the coolant passages in said support prongs.

4. A combination including the mining drill bit as defined in claim 2 having opposed, parallel chordal sides at the base of the body below the cutting edges of said cutting insert, and a driving steel having a driving end with chordal sides to register with the chordal sides of said bit and having a recess to receive said solid acircular driving shank formed with complemental walls to provide a driving relationship with said shank, and having passages formed on the internal walls of said recess to lie adjacent the external axial grooves of said shank to provide coolant supply passages leading to the coolant passages in said support prongs.

* * * * *